US007339314B2

(12) United States Patent
Shibahara et al.

(10) Patent No.: US 7,339,314 B2
(45) Date of Patent: Mar. 4, 2008

(54) MULTI-RINGED FLUORESCENT LAMP AND LIGHTING APPARATUS UTILIZING SAME

(75) Inventors: Yusuke Shibahara, Kanagawa-Ken (JP); Masahiko Yoshida, Kanagawa-Ken (JP)

(73) Assignee: Toshiba Lighting & Technology Corporation, Tokyo (JP)

( * ) Notice: Subject to any disclaimer, the term of this patent is extended or adjusted under 35 U.S.C. 154(b) by 459 days.

(21) Appl. No.: 11/125,180

(22) Filed: May 10, 2005

(65) Prior Publication Data

US 2005/0253526 A1 Nov. 17, 2005

(30) Foreign Application Priority Data

May 13, 2004 (JP) ..... 2004-143954
Feb. 28, 2005 (JP) ..... 2005-055090

(51) Int. Cl.
*H01J 1/62* (2006.01)
*H01J 63/04* (2006.01)
*H01J 17/16* (2006.01)

(52) U.S. Cl. ..... 313/493; 313/634

(58) Field of Classification Search ..... 313/634, 313/318.01, 318.02, 484, 493
See application file for complete search history.

(56) References Cited

U.S. PATENT DOCUMENTS 4,549,251 A * 10/1985 Chapman et al. ..... 313/264
5,034,655 A * 7/1991 Murayama et al. ..... 313/493
6,175,187 B1 * 1/2001 Tsutsui ..... 313/493
6,630,779 B1 * 10/2003 Tokes et al. ..... 313/493
2005/0212399 A1 * 9/2005 Holst ..... 313/493
2005/0253526 A1 11/2005 Shibahara et al.
2006/0071601 A1 * 4/2006 Yamada et al. ..... 313/634
2006/0164000 A1 * 7/2006 Nishimura et al. ..... 313/489

FOREIGN PATENT DOCUMENTS

JP 2005327634 A * 11/2005
JP 2006120426 A * 5/2006

* cited by examiner

*Primary Examiner*—Nimeshkumar D. Patel
*Assistant Examiner*—Peter Macchiarolo
(74) *Attorney, Agent, or Firm*—Oblon, Spivak, McClelland, Maier & Neustadt, P.C.

(57) ABSTRACT

A multi-ringed fluorescent lamp includes a multi-ringed bulb, a phosphor layer formed on an inner surface of the bulb, a pair of electrodes and discharge medium with which the bulb is filled. The bulb includes ring bulbs in each of which straight portions and bent portions are placed alternately on a same plane, by bending partially a glass tube having an outside diameter of 12-20 mm into a rectangular shape, so that opposite ends of the tube terminate with the adjacent straight portions. The ring bulbs are placed concentrically on the same plane and connected through a bridge connection portion to form a single discharge path. A gap between adjacent bent portions is larger than a gap between adjacent straight tube portions and has a maximum value of 6-15 mm. The electrodes are provided in opposite ends of the discharge path of the multi-ringed bulb.

8 Claims, 5 Drawing Sheets

MULTI-RINGED FLUORESCENT LAMP AND LIGHTING APPARATUS UTILIZING SAME

BACKGROUND OF THE INVENTION

1. Field of the Invention

The present invention relates to a fluorescent lamp having a multi-ringed structure or arrangement having a rectangular shape and a lighting apparatus utilizing such a fluorescent lamp.

2. Related Art

In recent years, in addition to conventional fluorescent lamps having straight structure or ringed structure, high luminance fluorescent lamps having a relatively smaller tube diameter and a high load on a tube wall have been placed on many kinds of markets. There exists, as a certain kind of lamp of these high luminance fluorescent lamps, a double circular fluorescent lamp in which two circular bulbs having the same diameter that have been formed by subjecting a straight glass tube to a bending process are placed apart from each other in a perpendicular direction to a diametrical direction of the bulb and then subjecting the corresponding end portions of these bulbs to a bridge connection process to form a single discharge path, thus providing the fluorescent tube, i.e., the discharge path having a length about twice as long as the conventional circular fluorescent lamp (as described in Japanese Patent Provisional (KOKAI) Publication No. 2001-243914).

However, because the above-described ringed fluorescent lamp has a circular shape, it is necessary to carry out a bending process after heating the bulb to soften, thus leading to deteriorated properties of a phosphor layer and the glass bulb caused by heat. Initial luminous flux and luminous flux maintenance factor are therefore inferior to those of the straight structure fluorescent lamp.

In view of these matters, the inventors of the subject application have previously developed a double ringed fluorescent lamp having a rectangular shape. The double ringed fluorescent lamp has a structure that two, large and small ring glass bulbs, in which straight tube portions and bent portions are connected alternately into a rectangular shape, are placed concentrically on the same plane, the corresponding end portions of these ring glass bulbs are connected to each other through a bridge connection process to thereby form a single discharge path, and a base is mounted so as to straddle a space between the corresponding other end portions of the ring glass bulbs.

Such a newly developed double ringed fluorescent lamp has the glass bulbs with a rectangular shape, for example, square shape, thus providing an excellent fittability for a lighting apparatus having a rectangular shape and permitting extension of the length of the discharge path. Further, there is no need to apply a heat bending treatment to the straight tube portions of the ring glass bulb, with the result that deterioration by heat can be restrained and a high luminous efficacy can be obtained, thus providing advantageous effects.

The above-mentioned double ringed fluorescent lamp having the rectangular shape has the following structural features by way of example. More specifically, the two large and small ring glass bulbs that are placed concentrically are provided with the bent portions so that the centers of radii of curvature of the both ring glass bulbs coincide with each other. Accordingly, the radius of curvature of the outer ring glass bulb is larger than that of the inner ring glass bulb. As a result, a gap between the two ring glass bulbs is identical to each other in any position of the straight tube portion and the bent portion. The double ringed florescent lamp therefore has a good external appearance.

However, the inventors of the subject application carried out extensive studies to further enhance luminescence power of the double ringed florescent lamp having the rectangular shape and obtained findings that the luminescence power of the double ringed florescent lamp could further be enhanced by changing or modifying a portion of the above-mentioned structure.

Incidentally, when carrying out a bridge connection process to manufacture the above-described double ringed fluorescent lamp in which the large and small ring bulbs are connected through a bridge connection portion to form a single discharge path, one ring glass bulb is usually shifted linearly in the axial direction of the bridge connection portion to be formed, relative to the other ring glass bulb. A smaller distance between the large and small ring glass bulbs leads to a good external appearance and a smaller length of the bridge connection portion, thus providing advantageous effects of improving a mechanical strength of the double ringed fluorescent lamp.

On the other hand, a smaller distance between the ring glass bulbs makes it difficult to ensure the shifting distance of the bulb in the axial direction of the bridge connection portion when forming the bridge connection portion. In view of this fact, it has been found to be preferable to shift the inner ring glass bulb relative to the outer ring glass bulb so as to bring the outer peripheral side surface of the former into contact with the inner peripheral side surface of the latter, in order to ensure the largest distance within which the inner ring bulb can be shifted relative to the outer ring bulb.

In the conventional fluorescent lamp, when the inner ring glass bulb 1B is shifted in the direction of an arrow shown with the solid line as shown in FIG. 7A, the straight tube portion 1*a*B thereof comes into contact with the straight tube portion 1*a*A of the outer ring glass bulb 1A. However, when application of external vibration causes the ring glass bulb 1B to deviate in the direction of an arrow shown with the dotted line after the shifting operation or in the direction of an arrow shown with the dashed line during the shifting operation, the bent portion 1*c*B of the inner ring glass bulb 1B comes into contact with the bent portion 1*c*A of the outer ring bulb 1A as shown in FIG. 7B, thus making it difficult to ensure the proper shifting distance. Because the shifting distance and the shifting direction when forming the bridge connection portion are restricted accordingly, a thick wall section is formed in the bridge connection portion to bring about strain, thus causing problems of deterioration of the mechanical strength.

SUMMARY OF THE INVENTION

An object of the present invention is therefore to substantially eliminate defects or drawbacks encountered in the conventional art mentioned above and to provide a multi-ringed fluorescent lamp with a rectangular shape, in which a shape of the ring glass bulb is improved to enhance luminescence power.

Another object of the present invention is to provide a multi-ringed fluorescent lamp with a rectangular shape, which has an improved structure in which an inner ring glass bulb of a pair of ring glass bulbs can be shifted relative to an outer ring glass bulb so that the outer peripheral surface of the straight tube portion of the former is placed close to the inner peripheral surface of the straight tube portion of the latter, without being subjected to restriction, by bent portions of the ring glass bulbs, of the shifting distance between the ring glass bulbs to which a bridge connection portion is to be formed.

A further object of the present invention is to provide a lighting apparatus utilizing such a fluorescent lamp as mentioned above.

The above and other objects can be achieved according to the present invention by providing, in one aspect, a multi-ringed fluorescent lamp comprising:

a multi-ringed bulb including a plurality of ring glass bulbs in each of which a plurality of straight tube portions and a plurality of bent portions are formed alternately on a same plane, by bending partially a glass tube having an outside tube diameter of from 12 to 20 mm into a rectangular shape so that opposite ends of the glass tube terminate with the straight tube portions located adjacently to each other, the ring-shaped glass bulbs being placed concentrically on the same plane and connected to each other through a bridge connection portion to form a single discharge path, and a gap between adjacent bent portions of the ring glass bulbs being formed to be larger than a gap between adjacent straight tube portions thereof and having a maximum value of from 6 to 15 mm;

a phosphor layer formed on an inner surface of the multi-ringed bulb;

a pair of electrodes provided in opposite ends of the discharge path of the multi-ringed bulb; and discharge medium filled in the multi-ringed bulb is filled.

In this aspect, it may be desired that the bent portions of the ring glass bulbs have substantially a same radius of curvature on an inner peripheral side thereof, said radius of curvature being within a range of from 15 to 50 mm.

According to the above one aspect, the gap between the adjacent bent portions of the ring-shaped glass bulbs of the multi-ringed bulb is set to be larger than the gap between the adjacent straight tube portions thereof so that the maximum distance of the former gap is within the range of from 6 to 15 mm. Even when the inner ring glass bulb is shifted toward the outer ring glass bulb to an extent that the outer peripheral surface of the straight tube portion of the former comes into contact with the inner peripheral surface of the straight tube portion of the latter, in order to form the bridge connection portion in the vicinity of the opposing ends of the pair of ring glass bulbs, it is possible to prevent the adjacent bent portions from coming into contact with each other, thus being insusceptible to limitation in the shifting distance and direction of the ring glass bulbs during the process of forming the bridge connection portion. As a result, it is possible to provide an easy formation of the bridge connection portion and prevent a thick wall section from being generated at the bridge connection portion, thus providing the multi-ringed fluorescent lamp in which strain does not easily occur.

In addition, the bent portions of the ring-shaped glass bulbs have substantially the same radius of curvature on the inner peripheral side thereof, and the radius of curvature is within the range of from 15 to 50 mm. This makes it possible to use a common mold when forming the bent portions of the ring glass bulbs, thus providing the multi-ringed fluorescent lamp, which can be manufactured by a manufacturing facility having the simple structure.

In another aspect of the present invention, there is also provided a multi-ringed fluorescent lamp comprising:

a multi-ringed bulb including a plurality of ring glass bulbs in each of which a plurality of straight tube portions and a plurality of bent portions are placed alternately on a same plane, by bending partially a glass tube having an outside tube diameter of from 12 to 20 mm into a rectangular shape so that opposite ends of the glass tube terminate with the straight tube portions facing each other to form one side of the rectangular shape, the ring glass bulbs being formed to be different in size from each other and placed concentrically on the same plane and connected to each other at end portions of each of the ring glass bulbs, which face each other in a form of an adjacent pair of ends, through a bridge connection portion to form a single discharge path, and a radius of curvature of an outer bulb of the ring glass bulbs on an inner peripheral side thereof being smaller than a radius of curvature of an inner bulb of the ring glass bulbs on an outer peripheral side thereof;

a phosphor layer formed on an inner surface of the multi-ringed bulb;

a pair of electrodes provided in opposite ends of the discharge path of the multi-ringed bulb; and discharge medium filled in the multi-ringed is filled.

In this aspect, it may be desired that a gap between adjacent straight tube portions of the plurality of straight tube portions of each of the outer bulb and the inner bulb is equal to 2 mm or more, but less than 6 mm, and a maximum gap between adjacent bent portions of the plurality of bent portions is equal to 6 mm or more, but 15 mm or less.

According to this aspect, the first radius of curvature (i.e., the radius of curvature of the inner peripheral side) of the bent portion of the outer ring glass bulb of the pair of adjacent ring glass bulbs, which are formed from the glass tube having the outside tube diameter of from 12 to 20 mm, is set to be smaller than the second radius of curvature (i.e., the radius of curvature of the outer peripheral side) of the bent portion of the inner ring glass bulb. As a result, formation of the gap between the bent portions, which corresponds to the difference between the first radius of curvature and the second radius of curvature, prevents the bent portions from coming into contact with each other, thus making it possible to shift the ring glass bulbs close to each other till the corresponding straight tube portions thereof come into contact with each other. Therefore, it becomes possible to provide the multi-ringed fluorescent lamp, which can avoid the problem that the above-mentioned shifting distance is restricted to be small.

In addition, the gap between adjacent straight tube portions of the straight tube portions of each of the outer bulb and the inner bulb of the multi-ringed bulb is equal to 2 mm or more, but less than 6 mm, and the maximum gap between adjacent bent portions of the bent portions is equal to 6 mm or more, but 15 mm or less. As a result, it is possible to provide the multi-ringed fluorescent lamp, which permits an easy formation of the bridge connection portion having good properties.

In a further aspect of the present invention, there is also provided a lighting apparatus comprising: a main body; a multi-ringed fluorescent lamp mounted on the main body; and a lighting circuit for supplying electricity to the fluorescent lamp to be lightened, the multi-ringed fluorescent lamp has the structure mentioned with respect to the above one and another aspects.

In such lighting apparatus, it may be desired that it further comprises a support member disposed to portions of the bent portions of the ring glass bulbs for supporting the multi-ringed fluorescent lamp on the main body.

According to the aspect of the lighting apparatus of the present invention, it is possible to provide the lighting apparatus which is provided with the advantageous effects and functions of the multi-ringed fluorescent lamp mentioned above.

In addition, the multi-ringed fluorescent lamp is supported on the main body by the supporting members at the bent portions of the plurality of ring glass bulbs constituting the multi-ringed bulb. As a result, there can be provided the lighting apparatus, which effectively reduces the dark area caused by the holding system of the multi-ringed fluorescent lamp.

It is to be noted that the present invention of the preferred embodiments mentioned above will be made more clearly understandable with reference to the following descriptions.

In the present invention, structural components of the multi-ringed fluorescent lamp and the lighting apparatus have the respective definitions and technical meanings, which will be described hereunder, with exceptions of specific meanings.

The multi-ringed fluorescent lamp of the present invention includes at least the multi-ringed bulb, the pair of electrodes, the phosphor layer and the discharge medium.

The multi-ringed bulb includes the plurality of ring glass bulbs that are placed concentrically on the same plane and the single discharge path, which is formed by connecting the ring glass bulbs to each other through the bridge connection portion. In each of the ring glass bulbs, the glass tube is locally bent to form the straight tube portions and the bent portions, which are placed alternately on the same plane, generally into a rectangular shape, so that opposite ends of the glass tube terminate with the straight tube portions located adjacently to each other. More specifically, the straight tube portions form four sides of the rectangular shape and the bent portions form four corners thereof. In addition, the plurality of ring glass bulbs are similar or substantially similar in shape. In the present invention, the term "on the same plane" means that there may be a permissible slight difference in level, for example, difference in level within a tube diameter of the ring bulb.

Each of glass tubes for forming the ring glass bulbs of the multi-ringed bulb has an outside tube diameter of from 12 to 20 mm. A preferable tube length of each of these glass tubes is within the range of from 800 to 3,000 mm. The outside tube diameter is based on measurement in the straight tube portion. However, a part of the straight tube portion, which is placed in the vicinity of the bent portion, may have the outside tube diameter that is slightly out of the above-mentioned range, due to a slight variation in the outside tube diameter during the bending process of the bent portion. Hence, requirement that the outside tube diameter of the major parts of the straight tube portion is within the above-mentioned range suffices in the present invention. In addition, the straight tube portion preferably has a thickness of from about 0.8 to about 1.2 mm. There is set a fundamental requirement that the outside tube diameter of the straight tube portion is within the above-mentioned range of from 12 to 20 mm. The optimum range thereof is from 14 to 18 mm in view of luminescence properties such as luminous efficacy, or luminous efficiency, and manufacturing conditions, as described below.

More specifically, it is commonly known that a smaller tube diameter of a fluorescent lamp leads to an enhanced luminous efficacy. In view of this fact, the outside tube diameter of the straight tube portion is limited to 20 mm or less in the present invention. The outside tube diameter of the straight tube portion of 20 mm or less can provide luminous efficacy, which is comparable to or higher than the conventional smaller-diameter circular structure fluorescent lamp. With the outside tube diameter of the straight tube portion of less than 12 mm, it is difficult to ensure the mechanical strength for the glass bulb having the bent portion, resulting in inapplicability. In addition, luminescence power, which is comparable to the conventional circular structure fluorescent lamp having the same size, cannot be obtained, resulting in impracticality.

In order to enhance the luminous efficacy of the conventional circular fluorescent lamp (type name of "FCL") having the outside diameter of 29 mm by at least 10%, it is necessary to reduce the outside diameter thereof to 65% or less. More specifically, the outside tube diameter of the straight tube portion of 18 mm or less suffices. Such an outside tube diameter can provide satisfactorily a low-profile fluorescent lamp. It is preferable to limit the outside diameter of the straight tube portion to 14 mm or more, taking into consideration characteristic properties such as luminescence power and luminous efficacy.

In a primary structural relationship that the ring glass bulbs are connected to each other through the bridge connection portion to form the single discharge path, the length of the glass tube exerts an influence on design factors such as the number of ring bulbs, an external size of the multi ringed bulb and a rated luminescence power. Accordingly, a proper determination of the length of the glass tube within the above-mentioned range of from 800 to 3,000 mm permits manufacture of the multi-ringed fluorescent lamp suitable for a lighting apparatus for common use. The above-mentioned length of the glass tube is based on measurement in the axial direction thereof.

In addition, a gap between the bent portions of the ring glass bulbs, which serve as a pair of adjacent bent portions in the multi-ringed bulb of the present invention, is determined within the range of from 6 to 15 mm at the maximum value thereof. Requirement that the maximum distance between the above-mentioned adjacent bent portions is determined within the above-given range provide functions and effects as described later. In the present invention, there is no limitation in concrete measures to set the maximum distance between the adjacent bent portions within the above-mentioned range. This can be achieved for example by setting the radius of curvature of the adjacent bent portions of the ring glass bulbs within the range of from 15 to 50 mm so as to be substantially equal to each other.

The radius of curvature of the bent portions is preferably set as follows. That is, more specifically, the radius of curvature of the inner peripheral side of the outer ring glass bulb of the pair of adjacent ring glass bulbs is set to be smaller than the radius of curvature of the outer peripheral side of the inner ring glass bulb. This enables the above-mentioned maximum distance to be easily obtained. This also makes it possible to shift the inner ring glass bulb toward the outer ring glass bulb till the outer peripheral surface of the straight tube portion of the former comes into contact with the inner peripheral surface of the straight tube portion of the latter, when forming the bride connection portion.

A gap between the adjacent straight tube portions of the ring glass bulbs, forming the multi-ringed bulb, is smaller than the maximum distance between the adjacent bent portions, and for example, in a usual case, is 2 mm or more and less than 6 mm, and preferably 3 mm or more and less than 6 mm, and most preferably, 4 mm.

The multi-ringed fluorescent lamp is provided on the inner surface of the multi-ringed bulb thereof with the phosphor layer. In a case where a straight glass blank tube is heated to soften and then bent to prepare the ring glass bulb, such a phosphor layer may be formed on such a blank tube.

In addition, in the multi-ringed fluorescent lamp, mercury and a rare gas may be used as the discharge medium with which the multi-ringed bulb is to be filled. Only a rare gas such as xenon may be used, as an occasion demands.

There is no limitation in number of the ring glass bulbs of which the multi-ringed bulb of the multi-ringed fluorescent lamp is composed. The double-ringed structure is preferable. However, thrice or more ringed structure may be applied as an occasion demands.

In the present invention, the gap between the adjacent bent portions of the ring glass bulbs of the multi-ringed bulb is set to be larger than the gap between the adjacent straight tube portions thereof so that the maximum distance of the former gap is within the range of from 6 to 15 mm, thus making it possible to improve luminescence power in the diagonal directions of the bulb having the rectangular shape at the four corners of which the bent portions are located. The reason is that formation of the gap of 6 mm or more enables the bent portion of the inner ring bulb, from which no light has been radiated originally due to a shadow caused by placing the ring bulbs adjacently, to be radiated outward in an effective manner.

According to the second aspect of the multi-ringed fluorescent lamp, the bent portions of the ring glass bulbs have substantially a same radius of curvature on an inner peripheral side thereof, said radius of curvature being within a range of from 15 to 50 mm, in the first aspect of the multi-ringed fluorescent lamp.

The present invention provides a structure, which permits an easy formation of the bent portions of the ring glass bulbs. More specifically, parts of the glass tube, at which the bent portions are formed, are heated to soften, and then subjected to a bending process. In the present invention, the same radius of curvature of the bent portions of the ring glass bulbs, which are different from each other in size, enables the bent portions to be formed in the same process conditions. This makes it possible to simplify the structure of the manufacturing facility. In case where the bent portions are formed with the use of a mold, the same mold can be applied commonly to the ring glass bulbs.

The radii of curvature on the respective inner peripheral sides of the bent portions are set to be within the range of from 15 to 50 mm, thus making it possible to heat easily the glass tube to soften to form the bent portions.

According to another aspect of the multi-ringed fluorescent lamp of the present invention, the multi-ringed fluorescent lamp, the ring glass bulbs are different in size from each other and placed concentrically on the same plane and connected to each other at end portions of each of the ring glass bulbs, which face each other in a form of an adjacent pair of ends, through a bridge connection portion to form a single discharge path, and a radius of curvature (hereinafter referred to as the "first radius of curvature") of an outer bulb of the ring glass bulbs on an inner peripheral side thereof being smaller than a radius of curvature (hereinafter referred to as the "second radius of curvature") of an inner bulb of the ring glass bulbs on an outer peripheral side thereof.

This multi-ringed fluorescent lamp permits an easy formation of the bridge connection portion, in addition to the functions and effects provided by the above-mentioned aspect of the present invention.

More specifically, according to the present invention, it is possible to shift the pair of ring glass bulbs relative to each other till the corresponding straight tube portions, which form an opposite side to the other side of the rectangular shape, on which the bridge connection portion is placed, come into contact with each other, and in other words, to ensure the shifting distance at the maximum, thus permitting an easy formation of the bridge connection portion.

Thus, the present invention makes it further possible to increase relatively longer and a relative shifting distance between the ring glass bulbs, when forming the bridge connection portion, and ensure appropriately a shifting direction, thus providing the bridge connection portion with excellent properties and preventing occurrence to the conventional fluorescent lamp.

Limitation of the thickness of the ring glass bulb within the range of from 0.8 to 1.2 mm enables the glass tube having the outside tube diameter of from 12 to 20 mm to be obtained easily, and further, permits a relatively easy formation of the bridge connection portion in combination with the other conditions as described above.

In addition, the fluorescent lamp may have a structure that a gap between adjacent straight tube portions of the plurality of straight tube portions of each of the outer bulb and the inner bulb is equal to 2 mm or more, but less than 6 mm, and a maximum gap between adjacent bent portions of the plurality of bent portions is equal to 6 mm or more, but 15 mm or less. According to such structure, the present invention gives an appropriate limitation in size of each of the straight tube portions and the bent portions of the pair of ring glass bulbs. The optimum distance between the adjacent straight tube portions is 4 mm.

According to the lighting apparatus provided with the multi-ringed fluorescent lamp of the structures and characters mentioned above, the lighting apparatus comprises a main body, the multi-ringed fluorescent lamp mounted on the main body and a lighting circuit for supplying lamp electricity to the fluorescent lamp.

In the present invention, the term "lighting apparatus" is a generic term, which includes any kind of apparatus utilizing the multi-ringed fluorescent lamp of the present invention, such as a luminescence, a beacon light, an indicator lamp and an advertising lamp. The term "main body" generally means structural elements of the lighting apparatus, other than the multi-ringed fluorescent lamp and the lighting circuit. The lighting apparatus may have a structure that the fluorescent lamp is illuminated in a closed area, which is provided by a translucent globe or a shade, but the apparatus may have a structure in which the lamp is illuminated in an area opening externally.

The lighting circuit is a circuit device for illuminating the fluorescent lamp. A high frequency lighting circuit is preferably used as the lighting circuit. The lighting circuit may include a switching device for output, as occasion demands. The switching device may be configured to switch selectively between a low power mode in which the fluorescent lamp is illuminated with high efficiency and a high power mode in which the lamp is illuminated at a high output. The switching device may have a function of causing a continuous variation between these modes. A switching operation of the switching device of the lighting circuit adjusts illuminance power of the fluorescent lamp.

The fluorescent lamp mounted to the lighting apparatus may be supported on the main body through the bent portions of the plurality of ring glass bulbs forming the multi-ringed bulb. According to this structure, it is possible to reduce a dark area caused by the holding system of the multi-ringed fluorescent lamp.

More specifically, in case of the multi-ringed fluorescent lamp in which the gap between the adjacent portions of the ring glass bulbs is relatively small, it is usual to support generally the ring glass bulbs to provide a stable mounting state. Such a supporting system of the multi-ringed fluorescent lamp makes the dark area of a light source relatively large. To the contrary, according to the present invention, there is a gap of from 6 to 15 mm at the maximum formed between the adjacent bent portions of the ring glass bulbs. The multi-ringed fluorescent lamp is generally supported by holding only one of the ring glass bulbs with the use of the bent portion of the bulb. Accordingly, there is provided an effect of reducing the dark area of the light source as described above.

There is no limitation in concrete structure of the above-mentioned holding mechanism. The main body of the lighting apparatus may include a lamp supporting member such as a flexible metallic band or a resilient band formed of synthetic resin, which holds the ring glass bulb at the outer peripheral surface thereof in the same manner as the common lighting apparatus. However, the multi-ringed fluorescent lamp may be provided at the pre-selected bent portion with the supporting member previously added thereof.

The nature and further characteristic features of the present invention will be made more clear from the following descriptions made with reference to the accompanying drawings.

DESCRIPTION OF THE PREFERRED EMBODIMENTS

Now, preferred embodiments of the present invention will be described in detail hereunder with reference to the accompanying drawings.

Figure 1:
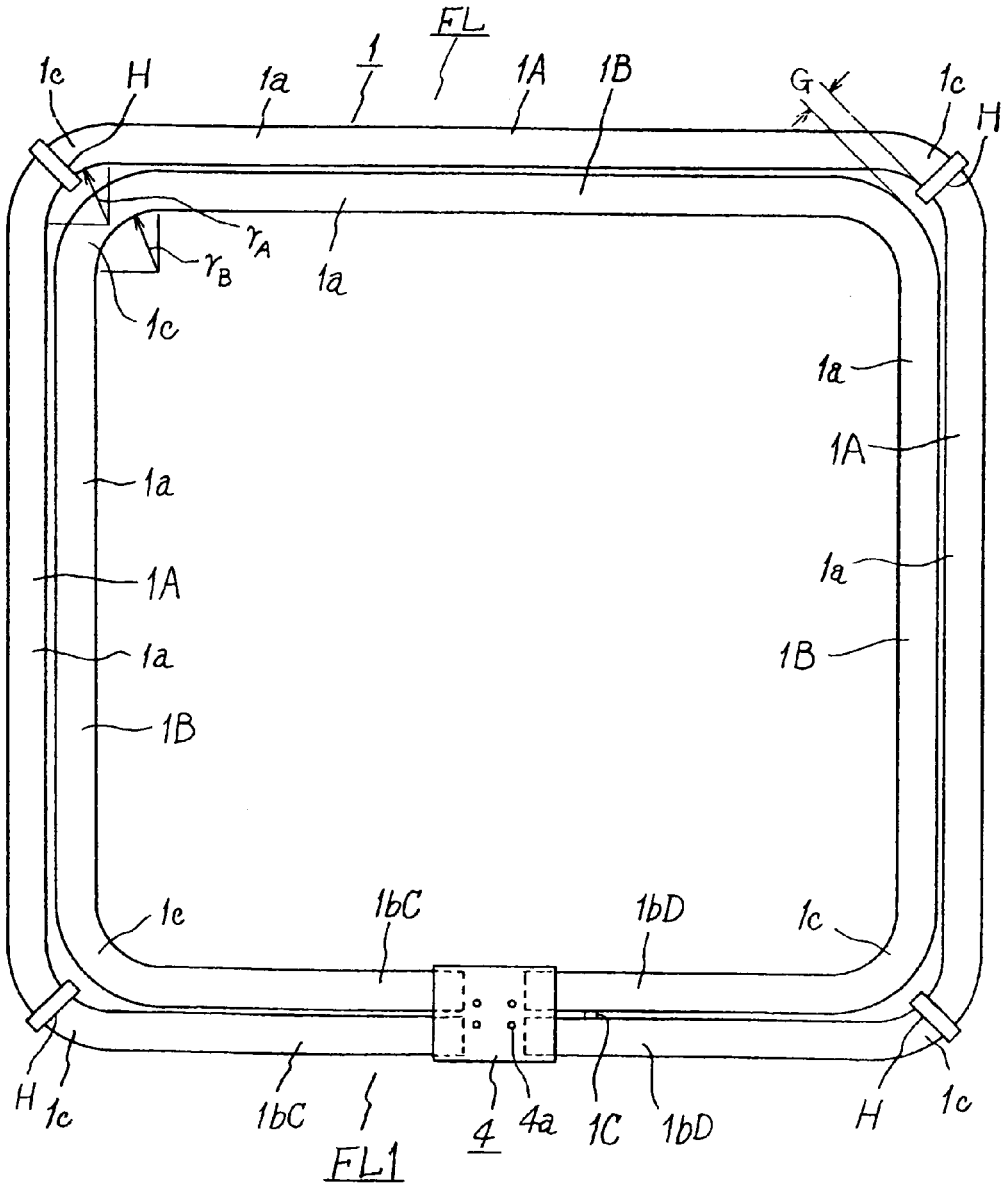
FIG. 1 is a front view illustrating a multi-ringed fluorescent lamp according to a first embodiment of the present invention.
Figure 2:
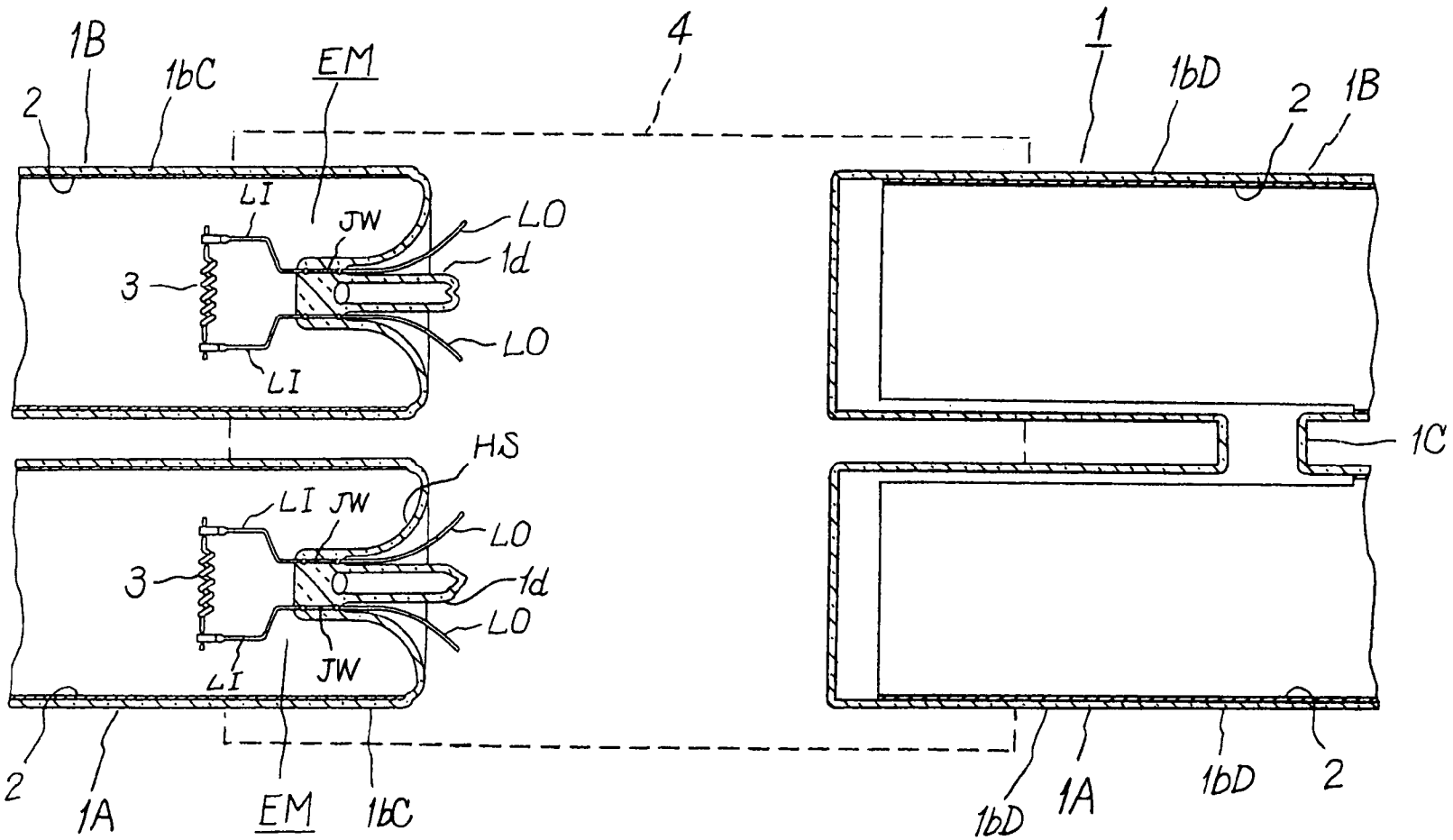
FIG. 2 is a front cross-sectional view, in an enlarged scale, of the fluorescent lamp of FIG. 1, cut along the vertical line thereof.

FIGS. 1 to 3 illustrate a fluorescent lamp according to the first embodiment of the present invention having a multi-ringed (or multiring) structure having rectangular, i.e. substantially square shape, which may be called hereinlater "multi-ringed fluorescent lamp" or merely "fluorescent lamp" for the sake of convenience.

With reference to FIGS. 1 to 3, the multi-ringed fluorescent lamp FL includes a multi-ringed bulb 1, a phosphor layer 2, a pair of electrodes 3, 3 and discharge medium, as clearly shown in FIG. 2 in an enlarged view. The multi-ringed fluorescent lamp FL further includes a common single base 4. In FIG. 1, a symbol "H" denotes a supporting member, which supports the multi-ringed fluorescent lamp FL as described later herein.

The multi-ringed bulb 1 has an outer ring glass bulb 1A and an inner ring glass bulb 1B, which are connected to each other through a bridge connection portion 1C to form a single discharge path. The outer ring glass bulb 1A and the inner ring glass bulb 1B are placed concentrically on the same plane so that a gap between the respective straight tube portions of these bulbs 1A and 1B is kept to be approximately 4 mm. Each of the outer ring glass bulb 1A and the inner ring glass bulb 1B is generally formed substantially into a square shape by partially heating a single glass blank tube at four positions thereof to soften and subjecting it to a pressing process with the use of a mold, so that the opposite ends of the glass blank tube are placed apart from each other at one of the four sides of the square shape.

Each of the outer ring glass bulb 1A and the inner ring glass bulb 1B preferably has a length of the one side "L" of 200 mm or more, and an appropriate selection is made to set the outside tube diameter of the respective straight tube portion thereof within the range of from 12 to 20 mm, and the thickness thereof within the range of from 0.8 to 1.5 mm, preferably within the range of from 0.8 to 1.2 mm. The outer ring glass bulb 1A and the inner ring glass bulb 1B are hereinafter simply referred to as "ring glass bulb 1A (or 1B)" when these bulbs are generally referred to.

In addition, the multi-ringed bulb 1 has a structure that the maximum distance "G" between a bent portion 1*c* of the outer ring glass bulb 1A and a corresponding bent portion 1*c* of the inner ring glass bulb 1B in each corner of the square shape is set within the range of from 6 to 15 mm so as to be larger than the gap of 3 mm between the corresponding straight tube portions 1*a*. The outer ring glass bulb 1A and the inner ring glass bulb 1B of the multi-ringed bulb 1 may be connected partially to each other, for example, between the corresponding straight tube portions 1*a* through a not-shown member formed of a transparent silicone resin material.

In more detailed description, each of the outer ring glass bulb 1A and the inner ring glass bulb 1B has five straight tube portions 1*a*, 1*a*, 1*a*, 1*b*C and 1*b*D that form the four sides of the square shape, and four bent portions 1*c*, 1*c*, 1*c* and 1*c* that form the corners of the square shape. More specifically, three straight tube portions 1*a*, 1*a*, 1*a* form the sequentially adjacent three sides of the square shape. Two straight tube portions 1*b*C, 1*b*D, which are located at the opposite ends of the single glass blank tube, form the remaining one side of the square shape. In addition, each of the straight tube portions 1*b*C formed by the respective end portions of the glass blank tubes is closed by an electrode mount EM hermetically provided thereto, as shown in FIG. 2. A bridge connection portion 1C is formed in the vicinity of the edge of each of the other straight tube portions 1*b*D formed by the respective other end portions of the glass blank tubes. Thus, the above-mentioned other straight tube portions 1*b*D of the outer ring glass bulb 1A and the inner ring glass bulb 1B are placed in parallel with each other and connected to each other through the bridge connection portion 1C in the vicinity of the edges of these straight tube portions 1*b*D.

The electrode mount EM is an assembled body, which is composed of a flare stem HS, a pair of internal lead wires LI, a pair of external lead wires LO, a pair of Dumet wires JW and an electrode 3 in the form of integral unit. Each of the flare stems HS is provided with a fine tube 1*d*, which communicates with the inside of the ring glass bulb 1A (or 1B) and fusion-bonded hermetically to the straight tube portion 1*b*C. The fine tube 1*d* is utilized as an air blowing port through which air is blasted, when forming a blast broken section on which the bridge connection portion 1C is to be formed. The fine tube 1*d* is also utilized when discharging air from the multi-ringed bulb 1 and filling it with discharge medium. The fine tube is closed hermetically after completion of the filing step of the discharge medium. The internal lead wires LI and the external lead wires LO are connected respectively to each other through the Dumet wires JW embedded hermetically in the flare stem HS. The electrode 3 is connected between the pair of internal lead wires LI.

As the other known sealing known structure, there may be provided a pinch sealing structure in which an electrode mount without a stem glass is hermetically provided in a direct connection manner, or a structure in which an electrode mount with a button stem or a bead stem is hermetically provided through the stem glass so as to provide a sealed state in place of the above-mentioned electrode mount EM.

The other straight tube portion 1*b*D of the ring glass bulb 1A (or 1B), which is formed by the other end portion of the glass blank tube, is closed at its end with glass in the form of flat wall.

The bridge connection portion 1C is formed in position, which is shifted from the outer ends of the respective other straight tube portions 1*b*D of the outer ring glass bulb 1A and the inner ring glass bulb 1B by a predetermined distance. The bridge connection portion 1C connects the outer ring glass bulb 1A and the inner ring glass bulb 1B to each other to form a single discharge path.

Figure 3A:
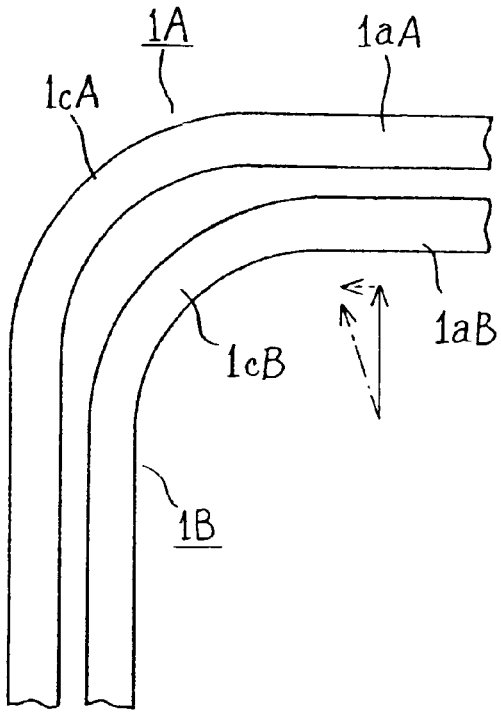
FIGS. 3A and 3B are partial front views in which a shifting distance between a pair of ring glass bulbs of the present invention is described.
Figure 3B:
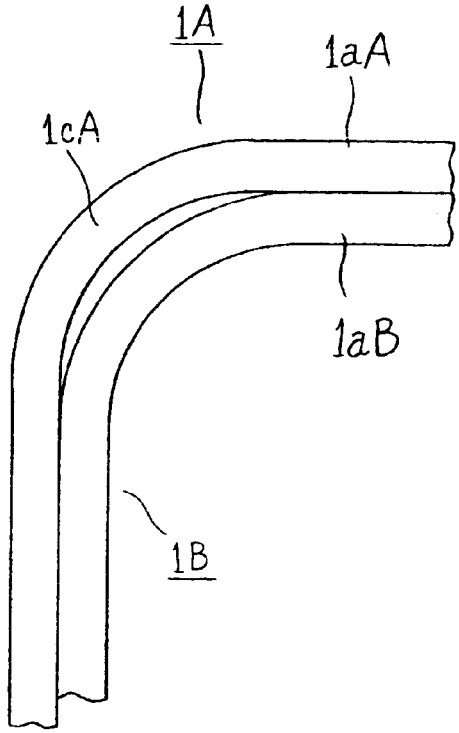

In a common manufacturing process, a shifting step is carried out to cause a relative movement between the outer ring glass bulb 1A and the inner ring glass bulb 1B, when forming the above-mentioned bridge connection portion 1C through the blast breaking process. In the present invention, the radius of curvature of the bent portion 1*c*A on the inner peripheral side thereof in the outer ring glass bulb 1A is smaller than the radius of curvature of the bent portion 1*c*B on the outer peripheral side thereof in the inner ring glass bulb 1B, as shown in FIGS. 3A and 3B. As a result, when carrying out the above-mentioned shifting step, the inner ring glass bulb 1B is permitted to be shifted toward the outer ring glass bulb 1A in a direction as shown by arrow in FIG. 3A till the outer peripheral side surface of the straight tube portion 1*a*B of the inner ring glass bulb 1B comes into contact with the inner peripheral side surface of the straight tube portion 1*a*A of the outer ring glass bulb 1A. As a result, it is possible to provide an easy formation of the bridge connection portion 1C and prevent a thick wall section from being generated at the bridge connection portion 1C, thus providing the bridge connection portion 1C having the improved characteristic properties.

The pair of electrodes 3, 3 are provided hermetically through the above-mentioned electrode mounts EM, respectively, at the respective ends of the outer ring glass bulb 1A and the inner ring glass bulb 1B of the multi-ringed bulb 1. As a result, the single discharge path, which extends from one electrode 3 to the other electrode 3 by way of the outer ring glass bulb 1A, the bridge connection portion 1C and the inner ring glass bulb 1B, is formed in the multi-ringed bulb 1.

The phosphor layer 2, which mainly includes three band (wavelength) fluorescent type phosphor, is formed on the inner surface of each of the pair of electrodes 3, 3 of the multi-ringed bulb. However, the phosphor layer is not formed on the inner surface of the bridge connection portion 1C in the vicinity of connected areas between the outer and inner ring glass bulbs 1A, 1B and the bridge connection portion 1C and at the respective opposite end portions of the outer and inner ring glass bulbs 1A and 1B. The phosphor layer 2 is formed by forming, prior to completion of steps of hermitically closing the opposite ends of the ring glass bulb 1A (or 1B), on the entire inner surface thereof and then removing the phosphor layer from the opposite end portions of the ring glass bulb 1A (or 1B) and its area on which the bridge connection portion is to be formed. A protective layer (not shown) containing metallic oxide particles such as y alumina is previously formed, prior to formation of the phosphor layer 2, on an area of the ring glass bulb 1A (or 1B), on which the phosphor layer is to be formed.

As a result, the phosphor layer 3 is formed through the protective layer on the inner surface of the outer ring glass bulb 1A and the inner ring glass bulb 1B. Partial removal of the phosphor layer 3 as mentioned above leads to partial removal of the protective layer.

The discharge medium, which includes mercury and argon (Ar), is charged into the multi-ringed bulb 1 through the fine tube 1*d* after formation of the multi-ringed bulb 1. The fine tube 1*d* is closed hermetically after completion of the filing step of the discharge medium.

The single base 4 is mounted so as to straddle a space between the opposite ends of the multi-ringed bulb 1. The base 4 has four base pins 4*a*, which are connected to the respective opposite ends of the electrodes 3, 3. Accordingly, the multi-ringed fluorescent lamp FL provides the closed square shape as a whole. Silicone resin may be charged into a receiving space of the base 4 to secure stationarily the base 4 to the ends of the multi-ringed bulb 1.

Now, the supporting members "H" shown in FIG. 1 will be described. The supporting member "H" is a fitting, which is obtained by curving a member such as a flexible metallic band so as to hold peripherally the bent portion 1*c* of the outer ring glass bulb 1A, thus enabling the multi-ringed fluorescent lamp FL to be mounted for example on a lighting apparatus. The maximum gap (i.e. distance) between the adjacent bent portions 1*c* is within the range of from 6 to 15 mm and larger than the gap between the adjacent straight tube portions 1*a* with the result that the multi-ringed fluorescent lamp FL can be supported by holding only one of the ring glass bulbs 1A and 1B.

In the multi-ringed fluorescent lamp FL according to the embodiment of the present invention, the gap between the adjacent bent portions 1*c* is set to be larger than the gap between the adjacent straight tube portions 1*a* so that the maximum distance "G" of the former gap is within the range of from 6 to 15 mm, thus enabling the radius of curvature "$r_A$" of the bent portion 1*c* of the outer ring glass bulb 1A and the radius of curvature "$r_B$" of the bent portion 1*c* of the inner ring glass bulb 1B to be substantially equal to each other, as shown in FIG. 1. In the first embodiment of the present invention, the maximum distance "G" is 11 mm and the radius of curvature "$r_A$", "$r_B$" is about 30 mm.

The radius of curvature of the bent portion 1*c* is preferably set as small as possible. Because the smaller radius of curvature leads to a small ratio of portions on which the bent portions are to be formed (i.e., the total length of the portions to be heated to soften) relative to the whole length of the straight tube glass blank tube before applying the bending process, it is permitted to restrain the deterioration of the phosphor and the glass bulb caused by heat. It is also expected that the smaller radius of curvature causes the tube axis of the bent portion 1*c* to be placed outside the center of the ring. Thus, the length of the discharge path can be increased accordingly. The above-mentioned structural features of the multi-ringed fluorescent lamp FL according to the embodiment of the present invention permits improvement in luminous efficacy or efficiency in comparison with the conventional case where the centers of the radii of curvature "$r_A$" and "$r_B$" of the bent portion 1*c* are placed in the same position.

There were made extensive studies of the minimum radius of curvature, which permitted to ensure appropriate mechanical strength and manufacturing yield when applying the bending process to the glass bulb having the outside tube diameter of from 12 to 20 mm, and there was obtained findings that the outside tube diameter was required to be set as 15 mm or more. The maximum radius of curvature is set as 50 mm or less. This limitation is based on the value, which is obtained from the upper limitation permissible value for the portions on which the bent portions are to be formed, when the maximum length of the straight glass tube blank bulb is set as 3,000 mm.

The same radius of curvature of the bent portions 1C permits reduced manufacturing costs for the mold, in a case where the common mold is used in the bending portion formation process. In addition, this permits the formation processes for the ring glass bulbs 1A and 1B to be carried out commonly. Even when the ring glass bulbs 1A and 1B are different in the tube diameter (i.e., width), an easy manufacture can be achieved in comparison with the case where the radii of curvature of the bent portions 1*c* are set individually for the respective ring glass bulbs 1A and 1B.

In addition, it is possible to reduce difference in luminescence power between the periphery of the bent portion 1*c* and the periphery of the straight tube portion 1*a* to enhance uniformity ratio of illuminance by limiting the maximum distance "G" within the range of from 6 to 15 mm. The straight tube portions 1*a*, which are placed adjacent to each other by a distance of 3 mm, may cause loss of luminescence power due to generation of a shadow of the adjacent bulb, thus making it difficult to take out effectively light in the radiating direction.

In the case of the high luminance multi-ringed fluorescent lamp. FL according to this first embodiment of the present invention, a positional relationship in which the bent portions 1*c* are placed adjacently to each other by the maximum distance "G" of from 6 to 15 mm permits to reduce loss of luminescence power, depending on luminance on the surface of the bulb. However, the luminescence power of the bent portion 1*c* is inferior to that of the straight tube portion 1*a* due to the deterioration by heat during the bending process. Accordingly, it is possible to enhance the luminescence power of the bent portion 1*c* to approach the luminescence power of the straight tube portion 1*a*, by limiting the maximum distance "G" between the bent portions 1*c* within the range of from 6 to 15 mm. Accordingly, the uniformity ratio of illuminance of the whole multi-ringed fluorescent lamp FL can be enhanced and a lamp image that does not produce uncomfortable feeling when an switching operation for illumination is carried out can be provided.

With the maximum distance "G" of over 15 mm, a dark area is generated between the bent portions 1*c*, thus providing unfavorable results.

It is also possible to cause the radius of curvature of the bent portion 1*c* of the outer ring glass bulb 1A to approximate to the radius of curvature of the bent portion 1*c* of the inner ring glass bulb 1B, with the result that a ratio in length of the bulb to be deteriorated by heat at the time of forming the bent portion 1*c* can be decreased and the illuminance power can be enhanced accordingly. The tube axis length can be increased by an amount corresponding to the reduced amount of radius of curvature of the bent portion 1*c* of the outer ring glass bulb 1A, thus leading to an increased length of the discharge path. Therefore, the illuminance power of the multi-ringed fluorescent lamp can easily be enhanced.

Even when the distance between the adjacent straight tube portions 1*a* of the ring glass bulbs 1A and 1B is small and, for example, of 3 mm, the gap between the bent portions 1*c*, 1*c* becomes larger, thus utilizing easily the gap between the bent portions 1*c*, 1*c* to hold the bent portion 1*c* of any one of the ring glass bulbs 1A and 1B of the multi-ringed bulb 1. It is therefore possible to mount the multi-ringed fluorescent lamp on the main body of the lighting apparatus by holding the bent portions 1*c*, for example, two to four bent portions 1*c* of either one of the ring glass bulbs 1A and 1B. Such a system of supporting the multi-ringed fluorescent lamp in a manner as described above provides advantageous effects such that the dark area caused in the light source by the supporting system can remarkably be reduced in comparison with a case where both the glass bulbs 1A and 1B are supported. The external appearance can therefore be improved when the lamp is illuminated. Any one of the ring glass bulb 1A and 1B may be utilized to support the multi-ringed bulb 1. In case of the double-ringed structure fluorescent lamp having two ring glass bulbs 1A and 1B, the outer ring glass bulb 1A may be held, and alternatively, the inner ring glass bulb 1B may be held.

Figure 4:
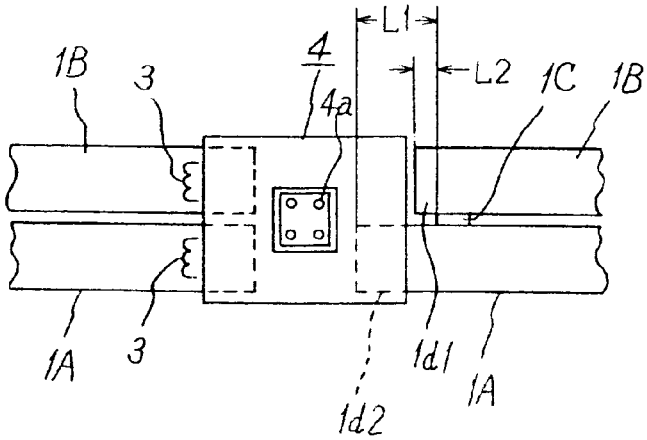
FIG. 4 is a partial schematic front view illustrating multi-ringed fluorescent lamp according to a second embodiment of the present invention.

FIG. 4 is a partial schematic front view illustrating the multi-ringed fluorescent lamp according to the second embodiment of the present invention. This second embodiment of the present invention includes, in addition to the structural features of the first embodiment as shown in FIGS. 1 to 3, the end of any one of the outer ring glass bulb 1A and the inner ring glass bulb 1B of the multi-ringed bulb 1, for example, the end 1*d*1 of the inner ring glass bulb 1B, which is placed on the side of the bridge connection portion 1C, is exposed outside the base 4, without being inserted therein. On the other hand, the end 1*d*2 of the outer ring glass bulb 1A, which is placed on the side of the bridge connection portion 1C, is inserted into the base 4. Silicone resin is charged into the receiving space of the base 4 to an extent that the multi-ringed bulb 1 and the base 4 are at least reliably connected to each other.

In this second embodiment of the present invention, a suitable relationship between a projection length "L1" between the outer surface of the bridge connection portion 1C and the end surface of the other of the outer ring glass bulb 1A and the inner ring glass bulb 1B of the multi-ringed bulb 1, for example, the outer ring glass bulb 1A, and a projection length "L2" between the outer surface of the bridge connection portion 1C and the end surface of the inner ring glass bulb 1B preferably satisfy the following relational expressions:

$$L1 \geqq L2; \text{ and}$$

$$2\ mm < L2 < 6\ mm$$

In this embodiment of the present invention, heat from the electrode 3 is easily transferred to the end 1*d*2 on the side of the bridge connection portion 1C through the silicone resin with which the receiving space of the base 4 is filled. However, the coolest zone in the multi-ringed bulb 1 is generated at the above-mentioned end 1*d*2 by exposing externally the end 1*d*1 of the outer ring glass bulb 1A, which is placed on the side of the bridge connection portion 1C. As a result, even when the multi-ringed fluorescent lamp FL is mounted on the lighting apparatus, there can be ensured luminescence with high luminous efficacy under the appropriate pressure of mercury vapor.

In addition, since the silicone resin is charged into the receiving space of the base 4 so as to secure the base 4 to the multi-ringed bulb 1 in an appropriate manner, the base 4 can be prevented from being kept in an unstable state.

Figure 5:
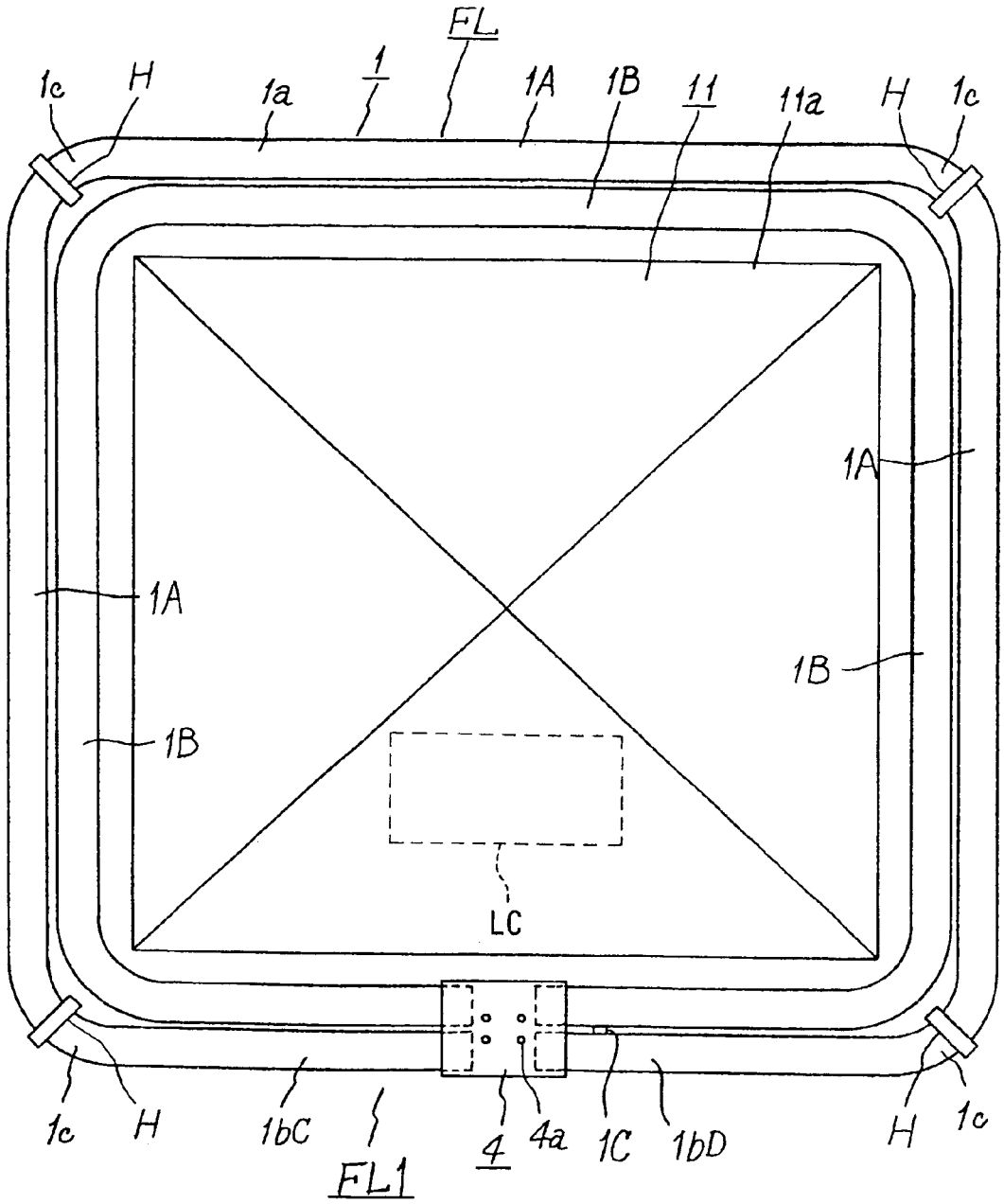
FIG. 5 is a front view illustrating a ceiling surface mounted type lighting apparatus according to another embodiment of the present invention.
Figure 6:
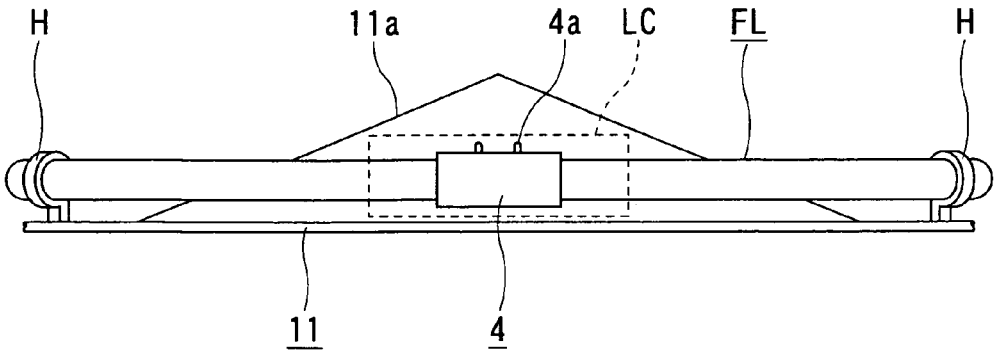
FIG. 6 is a bottom view of the lighting apparatus as shown in FIG. 5.
Figure 7A:
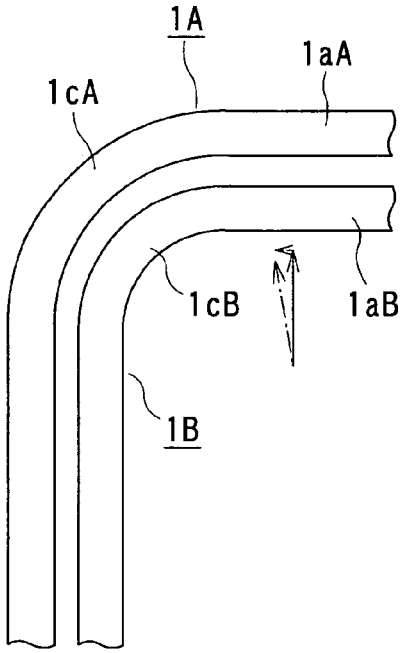
FIG. 7A PRIOR ART
FIGS. 7A and 7B are partial front views in which a shifting distance between a pair of ring glass bulbs of the conventional fluorescent lamp is described.
Figure 7B:
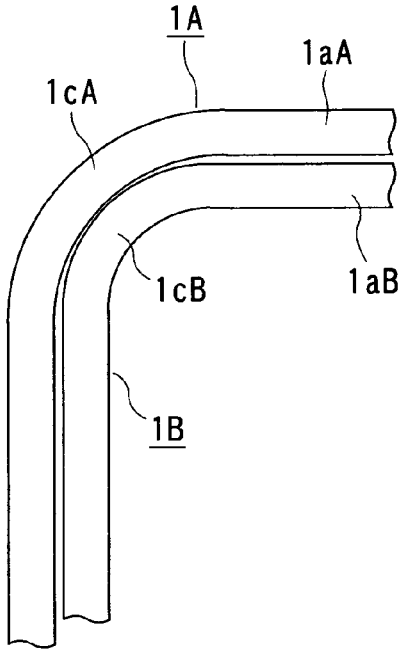
FIG. 7B PRIOR ART

FIGS. 5 and 6 represent a lighting apparatus of a ceiling mount type according to another embodiment of the present invention, in which the same reference numerals as in FIGS. 1 to 3 are given to the same or corresponding elements or components and the description thereof will be omitted herein.

The lighting apparatus of the shown type includes a main body 11, a multi-ringed fluorescent lamp FL and a high frequency lighting circuit LC.

The main body 11, which is to be mounted on a ceiling in use, is provided with a white reflector 11*a*, a lamp socket, not shown, and supporting members "H". The white reflector 11*a* is placed in the center of the lower surface of the main body 11 and has a shape of quadrangular pyramid. The lamp socket, which is a connection device for supplying electricity to the multi-ringed fluorescent lamp FL, is detachably provided in a position corresponding to the base 4 of the multi-ringed fluorescent lamp FL. The supporting members "H" hold the bent portions 1*c* of the outer ring glass bulb 1A of the multi-ringed bulb 1 of the multi-ringed fluorescent lamp FL so as to support the multi-ringed fluorescent lamp FL.

The multi-ringed fluorescent lamp FL has the same structure as shown in FIGS. 1 to 3. The multi-ringed bulb 1 is held by means of the supporting members "H" so as to be mounted in a predetermined position.

The high frequency lighting circuit LC is a device that converts an input power from a low frequency alternating-current power supply into a high frequency electric power and supplies the high frequency output to the multi-ringed fluorescent lamp FL through the lamp socket. The high frequency lighting circuit LC is placed in a space formed behind the white reflector 11*a* in the main body.

The reflector 11*a* of the main body 11, which has the shape of quadrangular pyramid, is placed in the central portion of the multi-ringed fluorescent lamp FL having the square shape, so as to provide luminous intensity distribution properties for the square shape in a downward direction from the lighting apparatus, thus being suitable to uniform illumination of a cubic room space.

It is further to be noted that the present invention is not limited to the described embodiments and many other changes and modifications may be made without departing from the scopes of the appended claims.

What is claimed is:

1. A multi-ringed fluorescent lamp comprising:

a multi-ringed bulb including a plurality of ring glass bulbs in each of which a plurality of straight tube portions and a plurality of bent portions are formed alternately on a same plane, by bending partially a glass tube having an outside tube diameter of from 12 to 20 mm into a rectangular shape so that opposite ends of the glass tube terminate with the straight tube portions located adjacently to each other, said ring-shaped glass bulbs being placed concentrically on the same plane and connected to each other through a bridge connection portion to form a single discharge path, and a gap between adjacent bent portions of the ring glass bulbs being formed to be larger than a gap between adjacent straight tube portions thereof and having a maximum value of from 6 to 15 mm;

a phosphor layer formed on an inner surface of the multi-ringed bulb;

a pair of electrodes provided in opposite ends of the discharge path of the multi-ringed bulb; and discharge medium filled in the multi-ringed bulb is filled.

2. A fluorescent lamp as claimed in claim 1, wherein the bent portions of the ring glass bulbs have substantially a same radius of curvature on an inner peripheral side thereof, said radius of curvature being within a range of from 15 to 50 mm.

3. A multi-ringed fluorescent lamp comprising:

a multi-ringed bulb including a plurality of ring glass bulbs in each of which a plurality of straight tube portions and a plurality of bent portions are placed alternately on a same plane, by bending partially a glass tube having an outside tube diameter of from 12 to 20 mm into a rectangular shape so that opposite ends of the glass tube terminate with the straight tube portions facing each other to form one side of the rectangular shape, said ring glass bulbs being formed to be different in size from each other and placed concentrically on the same plane and connected to each other at end portions of each of the ring glass bulbs, which face each other in a form of an adjacent pair of ends, through a bridge connection portion to form a single discharge path, and a radius of curvature of an outer bulb of the ring glass bulbs on an inner peripheral side thereof being smaller than a radius of curvature of an inner bulb of the ring glass bulbs on an outer peripheral side thereof;

a phosphor layer formed on an inner surface of the multi-ringed bulb;

a pair of electrodes provided in opposite ends of the discharge path of the multi-ringed bulb; and discharge medium filled in the multi-ringed is filled.

4. A fluorescent lamp as claimed in claim 3, wherein a gap between adjacent straight tube portions of the plurality of straight tube portions of each of the outer bulb and the inner bulb is equal to 2 mm or more, but less than 6 mm, and a maximum gap between adjacent bent portions of the plurality of bent portions is equal to 6 mm or more, but 15 mm or less.

5. A lighting apparatus comprising:

a main body;

a multi-ringed fluorescent lamp mounted on the main body; and a lighting circuit for supplying electricity to the fluorescent lamp to be lightened, said multi-ringed fluorescent lamp comprising:

a multi-ringed bulb including a plurality of ring glass bulbs in each of which a plurality of straight tube portions and a plurality of bent portions are formed alternately on a same plane, by bending partially a glass tube having an outside tube diameter of from 12 to 20 mm into a rectangular shape so that opposite ends of the glass tube terminate with the straight tube portions located adjacently to each other, said ring-shaped glass bulbs being placed concentrically on the same plane and connected to each other through a bridge connection portion to form a single discharge path, and a gap between adjacent bent portions of the ring glass bulbs being formed to be larger than a gap between adjacent straight tube portions thereof and having a maximum value of from 6 to 15 mm;

a phosphor layer formed on an inner surface of the multi-ringed bulb;

a pair of electrodes provided in opposite ends of the discharge path of the multi-ringed bulb; and discharge medium filled in the multi-ringed bulb is filled.

6. A lighting apparatus according to claim 5, further comprising a support member disposed to portions of the bent portions of the ring glass bulbs for supporting the multi-ringed fluorescent lamp on the main body.

7. A lighting apparatus comprising:

a main body;

a multi-ringed fluorescent lamp mounted to the main body; and a lighting circuit for supplying electricity to the fluorescent lamp to be lightened, said multi-ringed fluorescent lamp comprising:

a multi-ringed bulb including a plurality of ring glass bulbs in each of which a plurality of straight tube portions and a plurality of bent portions are placed alternately on a same plane, by bending partially a glass tube having an outside tube diameter of from 12 to 20 mm into a rectangular shape so that opposite ends of the glass tube terminate with the straight tube portions facing each other to form one side of the rectangular shape, said ring glass bulbs being formed to be different in size from each other and placed concentrically on the same plane and connected to each other at end portions of each of the ring glass bulbs, which face each other in a form of an adjacent pair of ends, through a bridge connection portion to form a single discharge path, and a radius of curvature of an outer bulb of the ring glass bulbs on an inner peripheral side thereof being smaller than a radius of curvature of an inner bulb of the ring glass bulbs on an outer peripheral side thereof;

a phosphor layer formed on an inner surface of the multi-ringed bulb;

a pair of electrodes provided in opposite ends of the discharge path of the multi-ringed bulb; and discharge medium with which the multi-ringed is filled.

8. A lighting apparatus according to claim 7, further comprising a support member disposed to portions of the bent portions of the ring glass bulbs for supporting the multi-ringed fluorescent lamp on the main body.

* * * * *